US006629811B1

(12) United States Patent
Husson

(10) Patent No.: US 6,629,811 B1
(45) Date of Patent: Oct. 7, 2003

(54) QUICK FASTENER SYSTEM FOR FIXING A TOOL AT THE END OF A LOADING ARM

(75) Inventor: Alain Husson, Orléans (FR)

(73) Assignee: Klac Industrie, Olivet (FR)

( * ) Notice: Subject to any disclaimer, the term of this patent is extended or adjusted under 35 U.S.C. 154(b) by 0 days.

(21) Appl. No.: 09/831,350

(22) PCT Filed: Oct. 21, 1999

(86) PCT No.: PCT/FR99/02560

§ 371 (c)(1),
(2), (4) Date: May 23, 2001

(87) PCT Pub. No.: WO00/29680

PCT Pub. Date: May 25, 2000

(30) Foreign Application Priority Data

Nov. 12, 1998 (FR) ..... 98 14185
Oct. 12, 1999 (FR) ..... 99 12671

(51) Int. Cl.[7] ..... B66C 23/00
(52) U.S. Cl. ..... 414/723; 403/321; 37/468
(58) Field of Search ..... 414/723; 403/321; 37/468

(56) References Cited

U.S. PATENT DOCUMENTS

| | | | | | |
|---|---|---|---|---|---|
| 3,934,738 | A | * | 1/1976 | Arnold | 214/145 |
| 4,436,477 | A | * | 3/1984 | Lenertz et al. | 414/723 |
| 4,480,955 | A | * | 11/1984 | Andrews et al. | 414/723 |
| 4,836,741 | A | | 6/1989 | St. Louis et al. | |
| 5,082,389 | A | * | 1/1992 | Balemi | 403/322 |
| 5,147,173 | A | * | 9/1992 | Fauber et al. | 414/723 |
| 5,224,816 | A | | 7/1993 | Kaczmarczyk et al. | |
| 5,597,283 | A | | 1/1997 | Jones | |
| 5,974,706 | A | * | 11/1999 | Kaczmarski et al. | 37/468 |

FOREIGN PATENT DOCUMENTS

| | | | | | |
|---|---|---|---|---|---|
| AT | 003005 U | | 7/1999 | | |
| EP | 0143074 | * | 5/1985 | | E02F/3/40 |
| EP | 0438931 | | 7/1991 | | |
| EP | 438931 A1 | * | 7/1991 | | E02F/3/40 |
| EP | 0521560 | | 1/1993 | | |
| EP | 0542120 | | 5/1993 | | |
| EP | 0594486 | * | 4/1994 | | E02F/3/36 |
| FR | 2641343 | | 7/1990 | | |
| FR | 2703113 | | 9/1994 | | |
| FR | 2765601 | | 1/1999 | | |
| FR | 2785952 | | 5/2000 | | |
| GB | 2267887 | | 12/1993 | | |
| WO | 98/46835 | | 10/1998 | | |
| WO | 01/92648 | | 12/2001 | | |

OTHER PUBLICATIONS

Patent Abstracts of Japan JP 06–272272.
English Language Abstract of EP 0 438 931.
English Language Abstract of EP 0 521 560.
English Language Abstract of FR 2 703 113.
English Language Abstract of EP 0 143 074.
English Language Abstract of EP 0 542 120.
English Language Abstract of FR 2 641 343.

* cited by examiner

*Primary Examiner*—Eileen D. Lillis
*Assistant Examiner*—Michael Lowe
(74) *Attorney, Agent, or Firm*—Greenblum & Bernstein, P.L.C.

(57) ABSTRACT

Quick fastener system for fixing a tool at the end of a loading arm. The system includes a first part coupled to the loading arm. The first part includes a cradle and a first aperture. A second part is arranged on the tool. The second part includes an element having a hook-shaped extension and a shaft which is adapted to be engaged by the cradle. A locking member is adapted to engage the hook-shaped extension. The tool is movable by the loading arm when the cradle engages the shaft and when the locking member engages the hook-shaped extension.

24 Claims, 7 Drawing Sheets

QUICK FASTENER SYSTEM FOR FIXING A TOOL AT THE END OF A LOADING ARM

CROSS-REFERENCE TO RELATED APPLICATIONS

The present application is a National Stage Application of International Application No. PCT/FR99/02560, filed Oct. 21, 1999. Further, the present application claims priority under 35 U.S.C. §119 of French Patent Application Nos. 98/14185 filed on Nov. 12, 1998 and 99/12671 filed on Oct. 12, 1999.

BACKGROUND OF THE INVENTION

1. Field of the Invention

The present invention relates to a quick fastener and/or a quick fastener system for fixing a tool, such as a bucket, at the end a loading arm, or the like.

In a known fashion, the quick fastener comprises two distinct portions, one of which is affixed to an arm and will be referred to as the catching member, whereas the other, which can cooperate with one arm, is the result of a modification of the tool or is constituted by an element affixed to the tool, and called hereinafter the "adapter."

2. Discussion of Background Information

The state of the art can be illustrated by a fastener, described in U.S. Pat. No. 4,836,741, whose catching member has hooks forming a cradle that is capable of catching a shaft borne by an adapter. By rotating the aforementioned member, bearings borne by the member and bearings provided on the tool are positioned so as to coincide, the affixing being obtained by axially engaging a shaft in the bearings. Such a device is not entirely satisfactory, because the operator of the apparatus is forced to step down from his machine. The coupling of the tool to the arm of the machine is therefore not automatic.

The device described in the French Patent No. 2641343 enables an automatic hooking. To this end, a longitudinally split sheath is used, which, under the action of springs, pivots and closes a cradle borne by the catching member by confining a shaft borne by the tool. In addition to the complexity of the mechanism, nothing is provided to eliminate the backlashes inherent in the various elements in contact.

The device described in the European Patent No. 438931 makes it possible to overcome the disadvantages of the aforementioned devices. In particular, it is characterized by the use of rotary cams which are automatically retracted during the pivoting of the catching member and take support beneath a locking shaft borne by the tool.

This device is completely automatic and enables the elimination of backlashes. However, its cost is high due, in particular, to the time required to assemble the various parts constituting the catching member which comprises the aforementioned cams. Moreover, the cams comprise bores that must be machined, and the distance between the axis of the cradle of the cam carrying shaft and that of the locking shaft must be accurate.

SUMMARY OF THE INVENTION

The invention provides for a quick fastener system for fixing a tool at the end of a loading arm. The system comprises a first part coupled to the loading arm. The first part comprises a cradle and a first aperture. A second part is arranged on the tool. The second part comprises an element having a hook-shaped extension and a shaft which is adapted to be engaged by the cradle. A locking member is adapted to engage the hook-shaped extension. The tool is movable by the loading arm when the cradle engages the shaft and when the locking member engages the hook-shaped extension.

The second part may be immobilized with respect to the first part when the cradle engages the shaft and when the locking member engages the hook-shaped extension. The locking member may comprise a plate. The first part may comprise a catching member which has substantially the shape of a bracket. The first aperture may be disposed in a median portion of the first part and the locking member may be disposed between the median portion and the hook-shaped extension. The second part may be one of fixed to the tool and integral with the tool. The locking member may be biased to engage the hook-shaped extension. The system may further comprise a guide mechanism for guiding the locking member, and the locking member may be constantly subject to a force that tends to move the locking member towards the shaft.

The system may further comprise a second aperture disposed in the locking member, wherein the second aperture is adapted to be substantially aligned with the first aperture when the tool is mounted to the loading arm. The system may further comprise a finger adapted to engage the locking member, and the finger may be one of movably mounted and pivotally mounted to the first part.

The finger may comprise a shoulder which is adapted to engage the locking member in order to maintain the locking member in an armed position. The finger may comprise an extended portion which is adapted to be engaged by an abutment disposed on the tool. The abutment may be disposed on the element and the abutment may engage the finger when the tool is pivoted towards a locked position. The first part may comprise an abutment which is adapted to engage the locking member. The abutment may be disposed on an upper surface of a median portion of the first part, and the abutment may maintain the locking member in an armed position against a force which acts to bias the locking member towards the hook-shaped extension. The locking member may also be biased towards the upper surface of the median portion. The element may comprise a shoulder which is adapted to engage the locking member. The element may further comprise a ramp which is adapted to engage an edge of the locking member so as to move the locking member away from the hook-shaped extension.

The locking member may be adapted to be moved away from the hook-shaped extension via an unlocking tool. The locking member may comprise two ears which each include a slit which is adapted to be engaged by at least one finger of the unlocking tool. The at least one finger of the unlocking tool may comprise an engaging pin which is adapted to engage the slit.

Each of the first part and the second part may comprise engaging surfaces which are adapted to immobilize the tool with respect to the first part. The engaging surfaces may be beveled. The element and the locking member may each comprise a corresponding tapered engaging surface.

The invention also provides for a quick fastener system for fixing a tool at the end of a loading arm. The system comprises a catching member pivotally connected to the loading arm and comprising a hook-shaped cradle. An element having a hook-shaped extension is mounted to the tool. A shaft which is adapted to be engaged by the cradle is mounted to the tool. A locking member is adapted to engage the hook-shaped extension. The loading arm is adapted to pivotally move the tool when the cradle engages the shaft and when the locking member engages the hook-shaped extension.

The invention also provides for a quick fastener system for fixing a tool at the end of a loading arm. The system comprises a first part movably mounted to the loading arm. The first part comprises a cradle, a biased movable locking member, and a mechanism for obstructing the movement of the locking member. A second part is coupled on the tool. The second part comprises an element having a hook-shaped extension and a shaft which is adapted to be engaged by the cradle. The tool is non-movably connected to the first part when the cradle engages the shaft and when the locking member engages the hook-shaped extension.

The present invention, which overcomes these disadvantages, comprises, in a known fashion, a catching member provided with a cradle capable of being mounted on a shaft, affixed to the tool, so that the latter can be lifted, and it is characterized in that the catching member, which has substantially the shape of a bracket, has on its median portion an aperture that can be crossed by an element having a hook-shaped extension and extending opposite said shaft of the tool, beneath which a locking plate borne by said member can be inserted, maintaining the latter applied against the tool.

The aforementioned shaft and abutment can be made integral with an adapter fixed on the tool by any usual means.

BRIEF DESCRIPTION OF THE DRAWINGS

The present invention will be better understood from the description that follows, with reference to the annexed drawings, provided by way of examples only, in which.

DETAILED DESCRIPTION OF THE INVENTION

Figure 1:
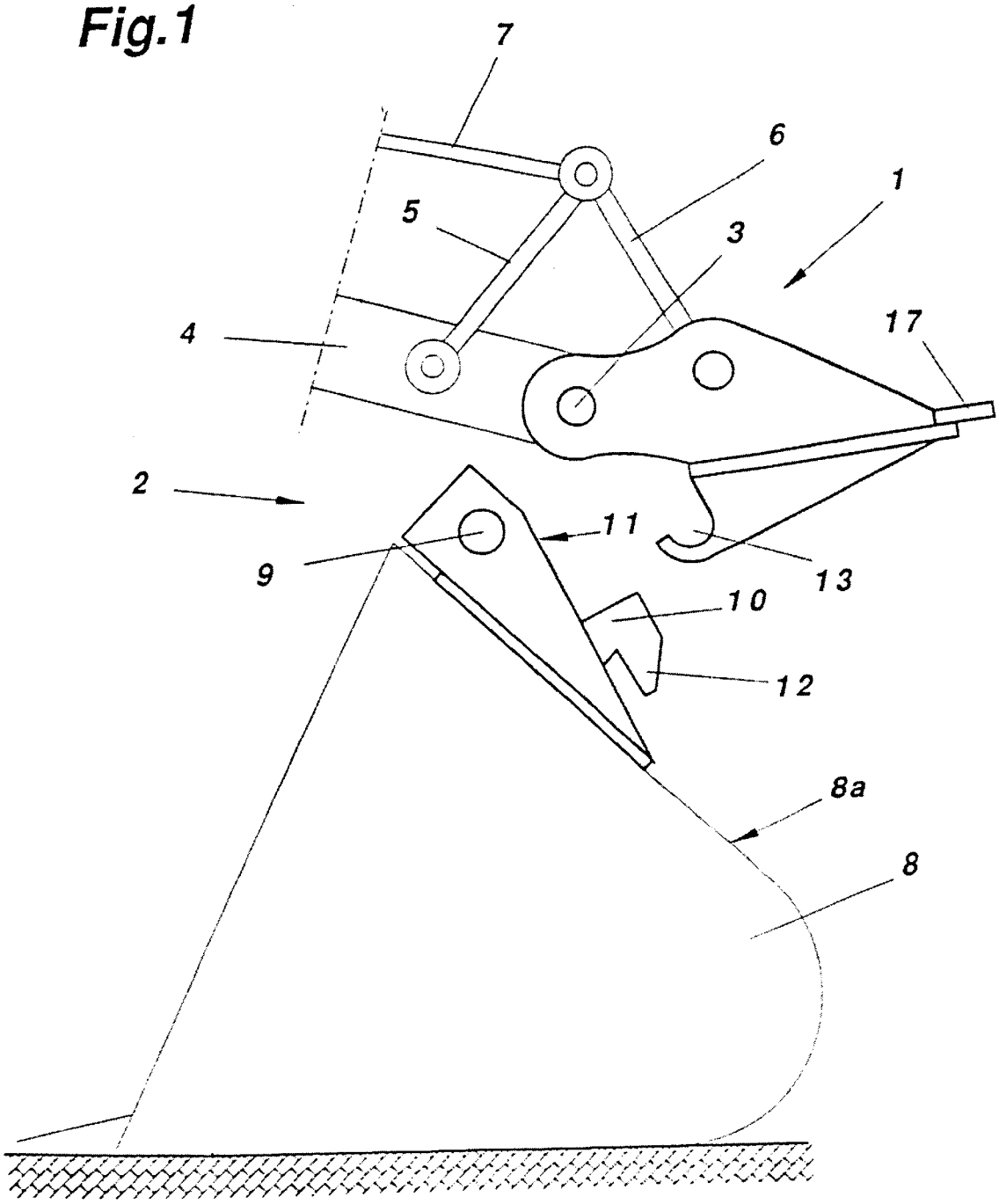
FIG. 1 is an elevated view of a quick fastener according to the invention applied to the fixing of a bucket at the end of the loading arm.

In a known fashion, the quick fastener comprises two portions 1 and 2. A first portion 1, which constitutes a catching member is journalled by a shaft 3 at the end of an arm 4 of a mechanical shovel. This mechanism can pivot about an axis of the shaft 3 by the conjugated action of two connecting rods 5 and 6 which are controlled by a piston rod 7 of a conventional jack. A second portion 2, or adapter, is affixed to a tool 8 which may be a bucket, in the example shown. According to another embodiment, the mechanism constituting the adapter 2 can be made integral with the tool 8.

In its simplest form, the adapter 2 is in the form of a bracket-shaped element, which is affixed by its median portion to a surface 8*a* of the tool 8. Two arms of the bracket or adapter 2 are connected by a shaft 9. The median portion also has an element 10 which extends beyond the sides 11. The element 10 has an extension portion 12 which extends in a direction opposite the shaft 9.

Figure 8:
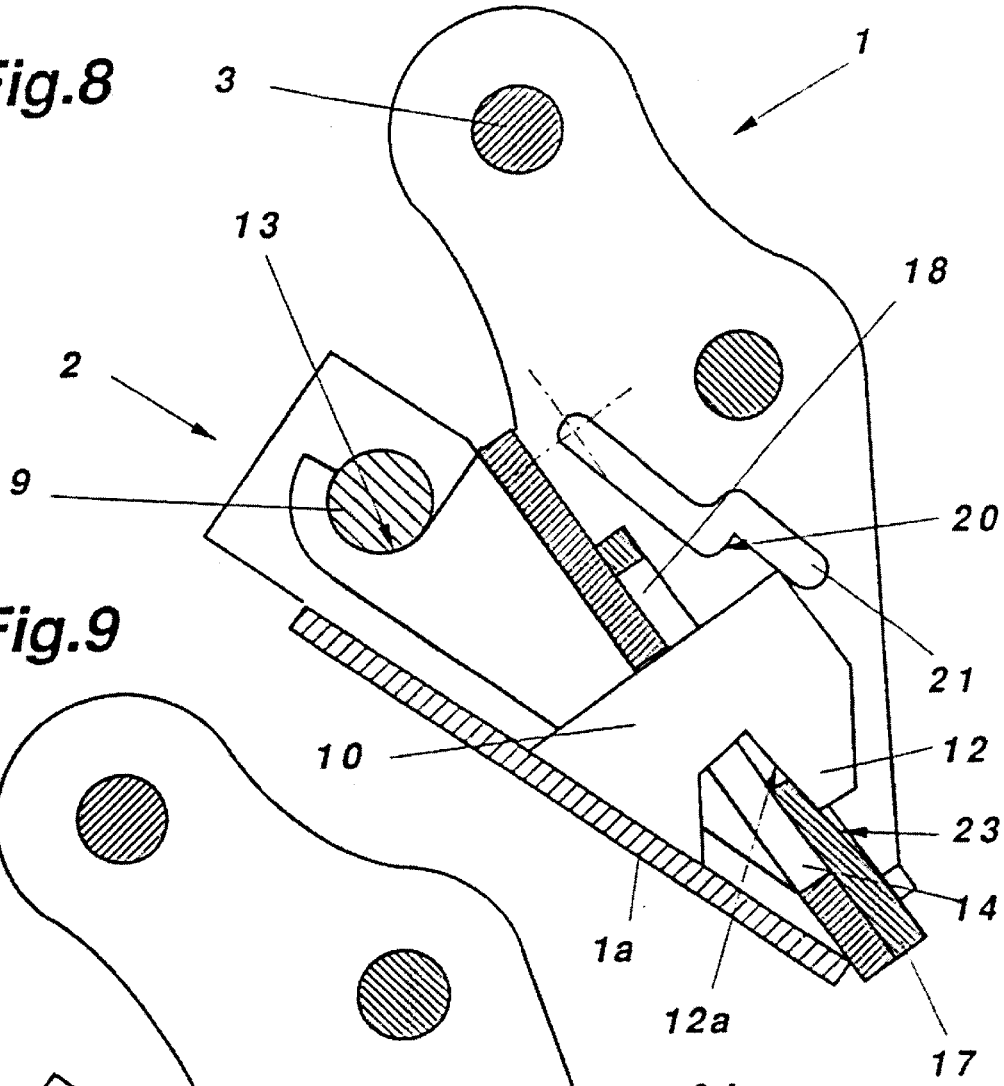
FIG. 8 is a view, on a larger scale and limited to the fastener, showing the catching member locked on the adapter.

In a known fashion, the first portion or catching member 1 has a cradle 13 which forms a hook. This arrangement makes it possible to lift the tool 8, when the shaft 9 rests in the cradle 13, as shown in FIG. 8.

According to one embodiment, the catching member 1 has substantially the shape of a bracket having side arms through which the shaft 3 extends.

A median portion 1*a* of the member 1 also has an aperture 14 through which the element 10 can extend during the pivoting and/or rotation of the member 1 about the axis of the shaft 3.

In the example shown, the upper portion of the element 10 forms an abutment 15 capable, when it meets a pivoting finger 16, of releasing a locking plate 17 which can slide on the median portion of the member 1 so as to be inserted beneath the extension 12.

Figure 2:
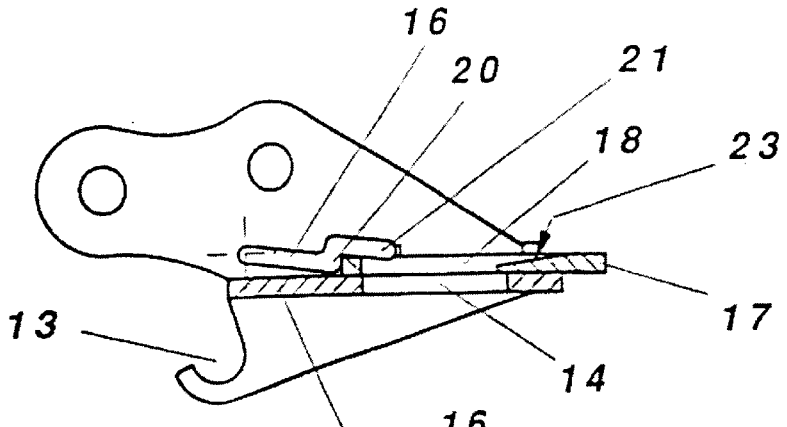
FIG. 2 is a vertical cross-sectional view of the catching member.

According to one embodiment, a plate 17 has an aperture 18 adapted to substantially coincide with aperture 14 when the plate 17 is in the "armed" position, i.e., in the position shown in FIG. 2.

Figure 3:
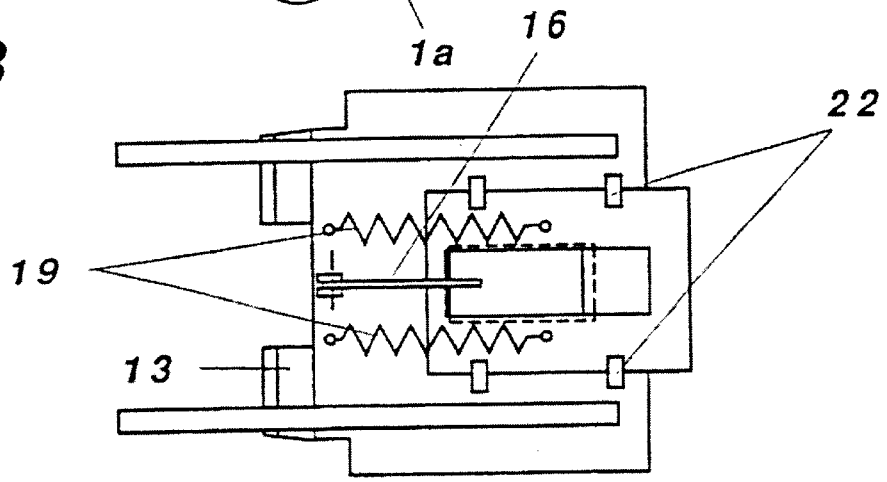
FIG. 3 is the top view of FIG. 2.
Figure 4:
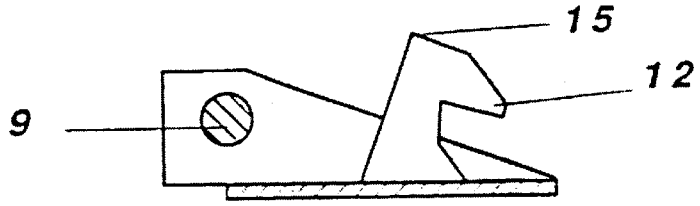
FIG. 4 is a vertical cross-sectional view of the adapter.
Figure 5:
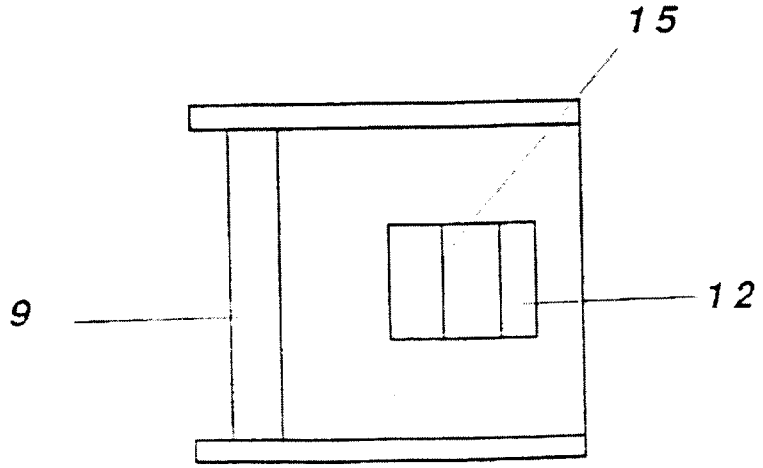
FIG. 5 is the top view of FIG. 4.

The plate 17 is constantly subject to the action of a force that tends to move it toward the cradle 13 to seal the aperture 14. In the example shown, this force is materialized by two springs schematically designated by the reference numeral 19 (see FIG. 3).

A mechanism is provided to maintain the plate 17 in the armed position.

Thus, the plate 17 can be maintained in the armed position by the locking and/or pivoting finger 16. As shown in the drawings, the finger 16 is journalled at one of its ends above the median portion 1 a, such that under the action of its weight, it tends to pivot toward the latter (i.e., clockwise in FIG. 2) and to be maintained in this position. As a precautionary measure, this action can be reinforced by utilizing a spring (not shown).

The finger 16 has a shouldered portion 20 against which an edge corresponding to the plate 17 is supported and/or engaged. Finger 16 also has an extension portion 21 that extends above the aperture 14.

The operation of the hooking between the first portion 1 and the second portion 2 will now be explained.

Figure 6:
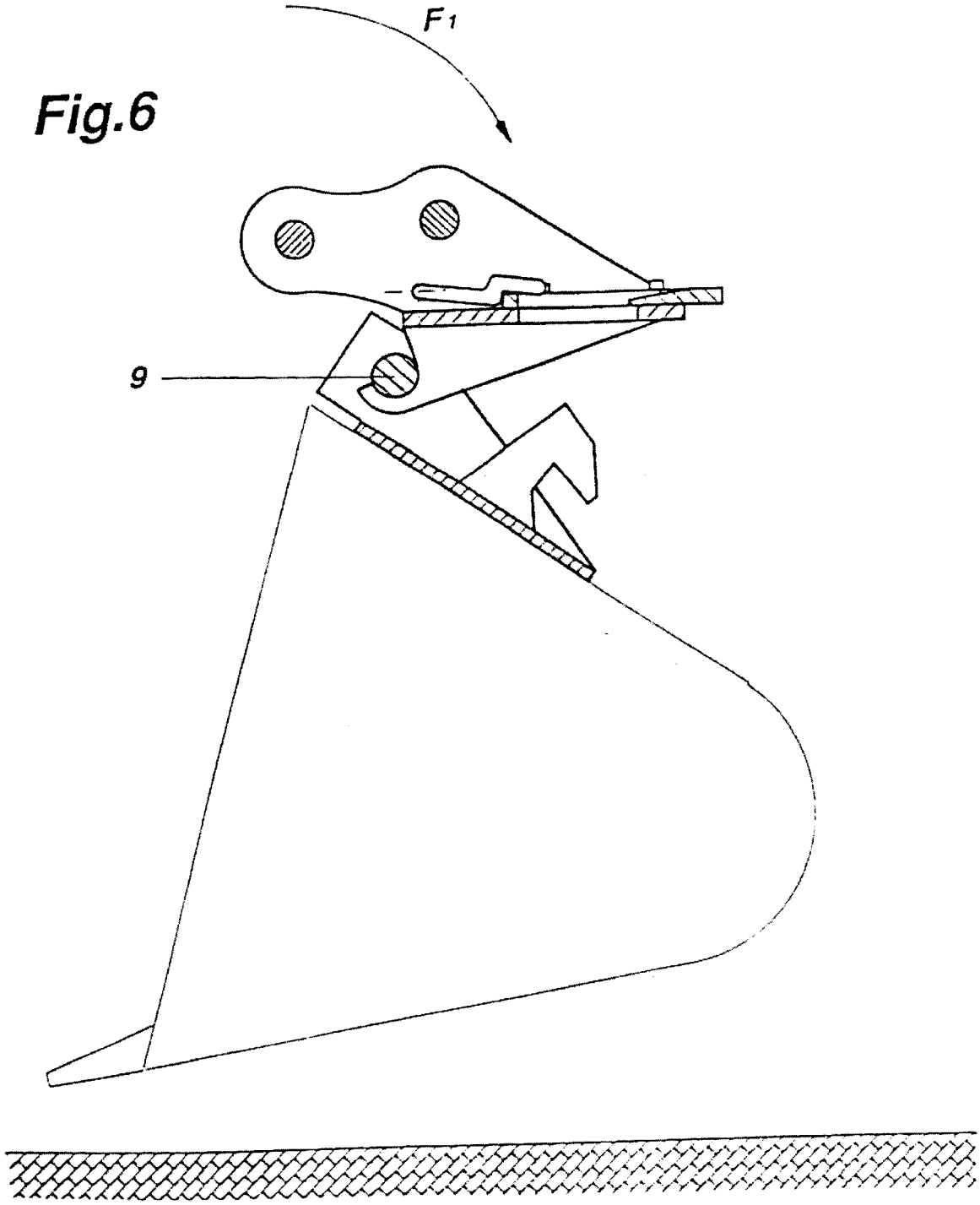
FIG. 6 is a vertical cross-sectional view of the fastener of the invention, showing the first catching step, which is the lifting of the tool.
Figure 7:
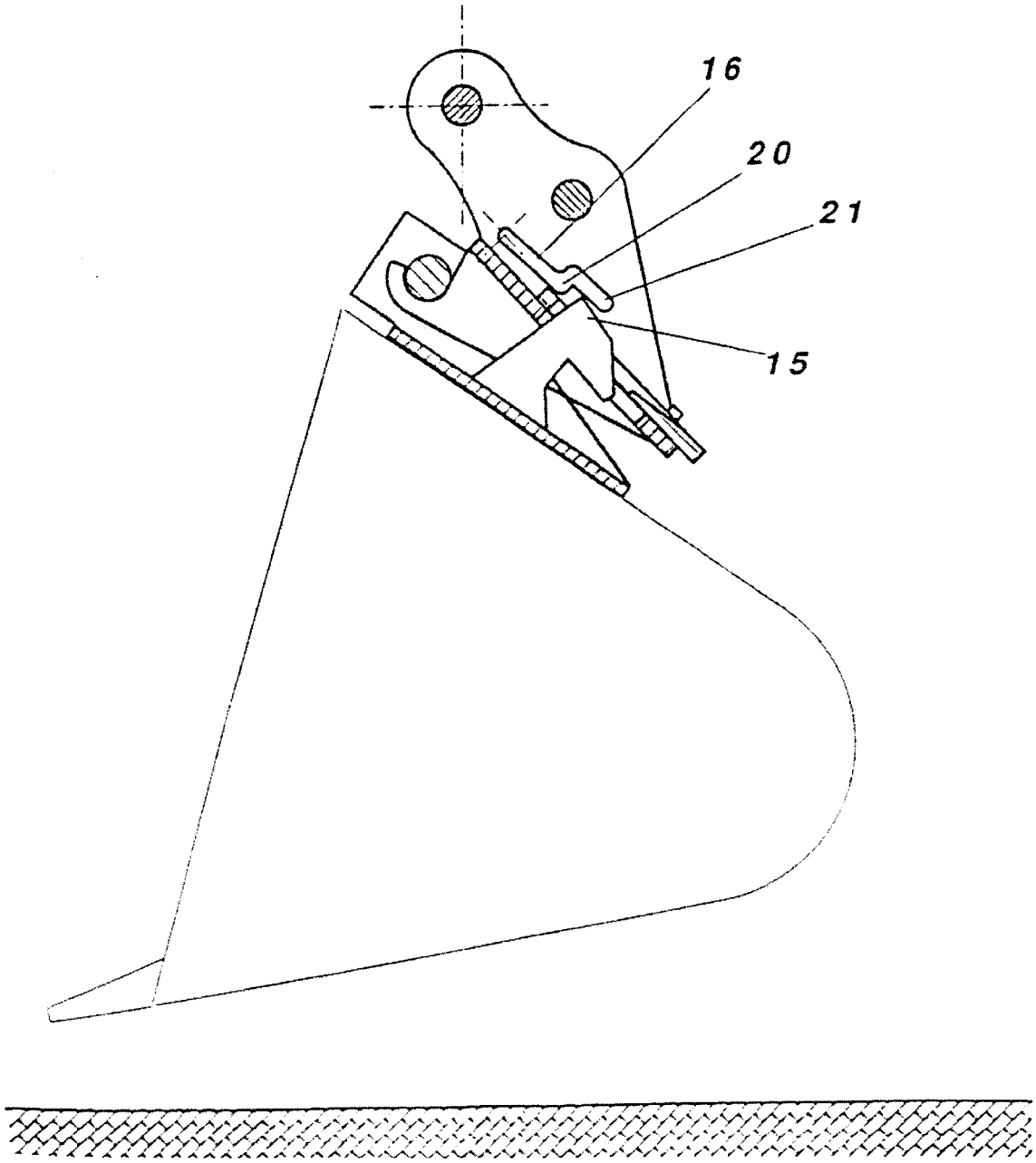
FIG. 7 is a view, similar to FIG. 6, which shows a subsequent catching step.

By maneuvering the arm 4 and the piston rod 7, the tool 8 is caught in the cradle 13 and lifted so as to bring it into the position shown in FIG. 6.

Next, the member 1 is pivoted along the arrow $F_1$ by extending the piston rod 7. During this movement, an abutment 15 meets the extension 21 of the finger 16 and pushes it back so as to release the plate 17 which, under the action of return springs, is caused to be inserted beneath the extension 12 (FIG. 8). As a result, portion 1*a* of the member 1 is supported, by its lower surface, against the sides 11 of the adapter 2.

In the example shown, the extension 12 and the abutment 15 are integral with the element 10, but these two functions could also be ensured by two distinct members.

The plate 17 is guided, as is schematically shown in the drawings, by the guides 22.

The contact between the extension 12 and the locking plate 17 occurs via surfaces that are oblique with respect to the moving direction of the plate 17.

As it appears from the drawings, the locking plate 17 is beveled at a right angle with its portion 23 which must be inserted beneath the extension 12. According to one embodiment, this portion forms, together with the lower surface of the plate 17, an angle on the order of 7°. In the same manner, the surface 12*a* (FIG. 8) of the extension 12, which must be in contact with the portion 23, forms an identical angle with the support surface of the adapter 2 materialized by the edges 11. In this way, the catching member is strongly applied against the adapter 2 under the effect of the force developed by the springs 19, which tends to cause the locking plate to penetrate beneath the extension 12.

Figure 9:
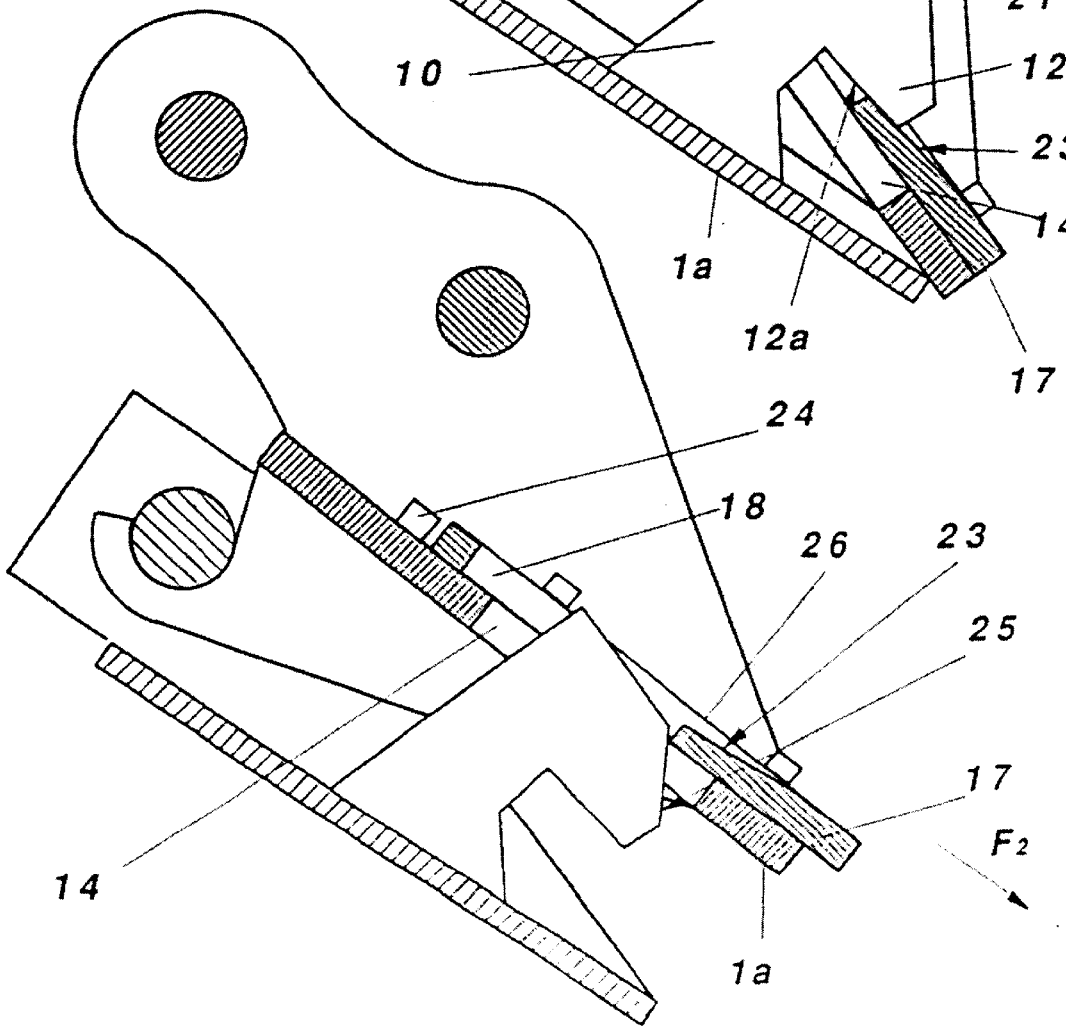
FIG. 9 is a view, similar to that 8, which shows an alternative embodiment of the invention, the tool being hooked.
Figure 10:
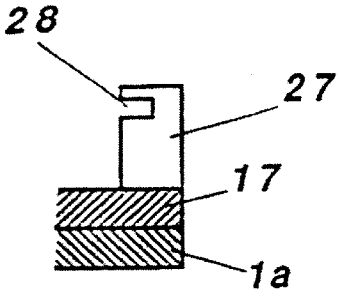
FIG. 10 is a partial view, in vertical cross-section, showing a particular embodiment of the locking member.
Figure 11:
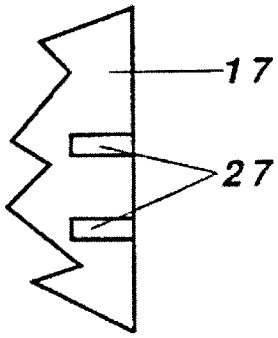
FIG. 11 is the top view of FIG. 10.
Figure 12:
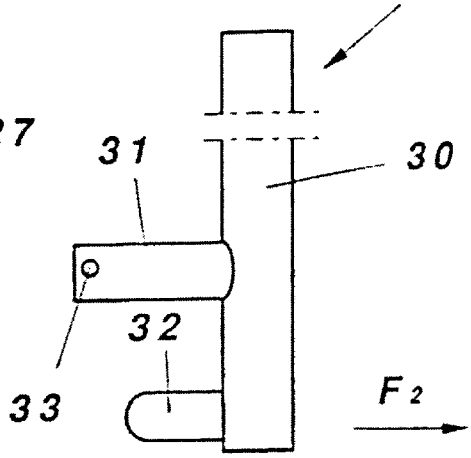
FIG. 12 is an elevated view showing an embodiment of a tool that makes it possible to manually disconnect the bucket.
Figure 13:
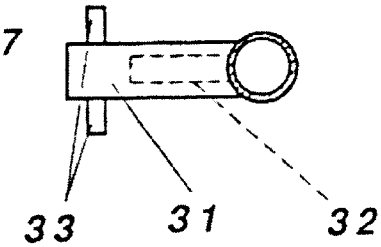
FIG. 13 is the top view of FIG. 12.
Figure 14:
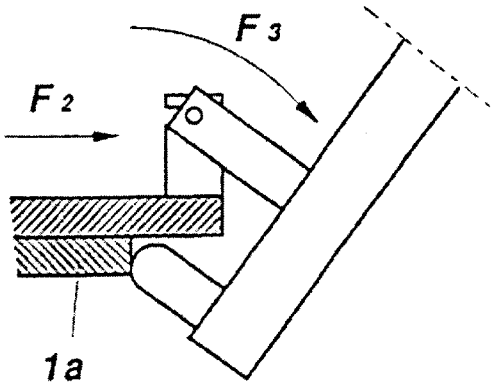
FIG. 14 shows the use of the tool of FIG. 12.

FIG. 9 shows an embodiment which makes it possible to eliminate the locking finger 16.

Under the action of the force that tends to displace the plate 17, the latter is applied against an abutment 24 and partially seals the aperture 14.

The extension 12 has a ramp 25 at its end. During the rotation of the member 1, the upper portion of the ramp 25 meets the edge 26 of the aperture 18 of the locking plate 17 and displaces the latter against the force to which the latter is subject, i.e., in the direction of the arrow $F_2$. When the aforementioned rotation ceases, the end of the extension 12 is located above the aperture 18, and the plate 17, under the action of the force to which it is subject, is inserted beneath the extension.

The locking finger 16 can also be replaced by a hydraulic jack (not shown).

In certain cases, a manual unlocking may seem preferable, as will now be described with reference to FIGS. 10–14.

It is understood that to separate the tool 8, the locking plate 17 must be displaced in the direction of the arrow $F_2$.

To this end, the free end of the plate 17, opposite the shaft 3, has two ears 27 each having a slit 28 which opens toward the shaft 3. This arrangement enables the use of a tool 29 (FIG. 12) comprising a handle 30 and, at one of its ends, two fingers 31 and 32, finger 31 comprising two diametrically opposed pins 33.

During the introduction of the pins into the slits 28, the lower finger 32, which is suitably sized, takes support against the edge of the median portion 1*a* of the member 1.

Therefore, it is understood that by pivoting this handle 30 along the arrow $F_3$, one drives the plate 17 which moves along the arrow $F_2$.

The invention also provides a mechanism for opposing the generation of backlashes between the portions 1 and 2, and to eliminate the same if they are produced.

Figure 15:
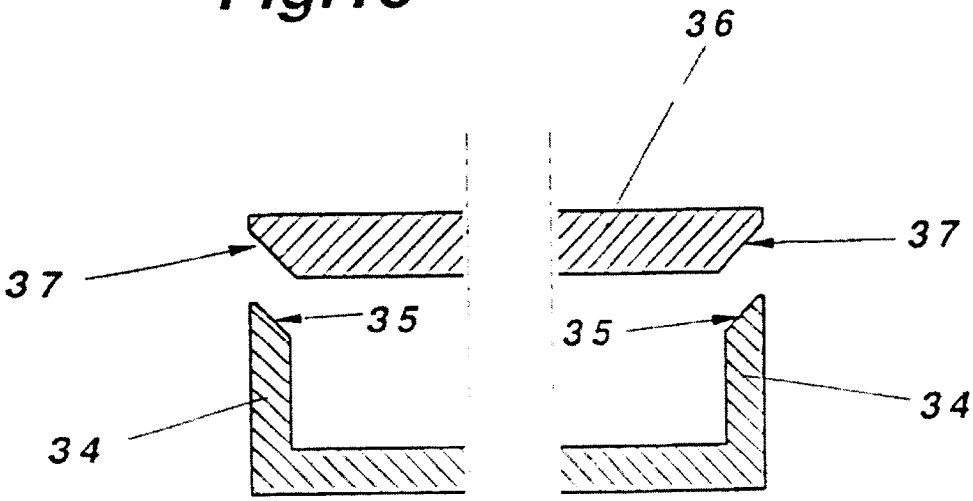
FIG. 15 is a partial view, in transverse cross-section, showing a mechanism which makes it possible to eliminate the backslashes between the two portions of the fastener.

According to one embodiment, the adapter 2 has two sides 34 (see FIG. 15) which extend perpendicularly to shaft 9, and whose edges 35 are machined so as to form a V. The median portion 1*a* of the catching member 1 comprises a plate 36 whose edges 37 are beveled so as to form a V. Accordingly, it is understood that when the two portions 1 and 2 are assembled, portion 1 is immobilized transversely with respect to portion 2, and vice versa as a result of this design, i.e., the resulting contact between edges 35 and 37.

Naturally, the necessary machinings required to obtain the edges 35 and 37 can be carried out directly on the edges 11 of the adapter 2 and on those of the median portion 1*a* of the member 1.

Another embodiment is provided which makes it possible to maintain the plate 17 in the armed position, which is described with reference to FIGS. 16 and 17.

According to the invention, the median portion 1*a* has, on the surface against which the locking plate 17 takes support, a small abutment 38 against which the end 17*a* of the plate 17 is applied under the effect of the springs 19 when the apertures 14 and 18 substantially coincide.

Figure 16:
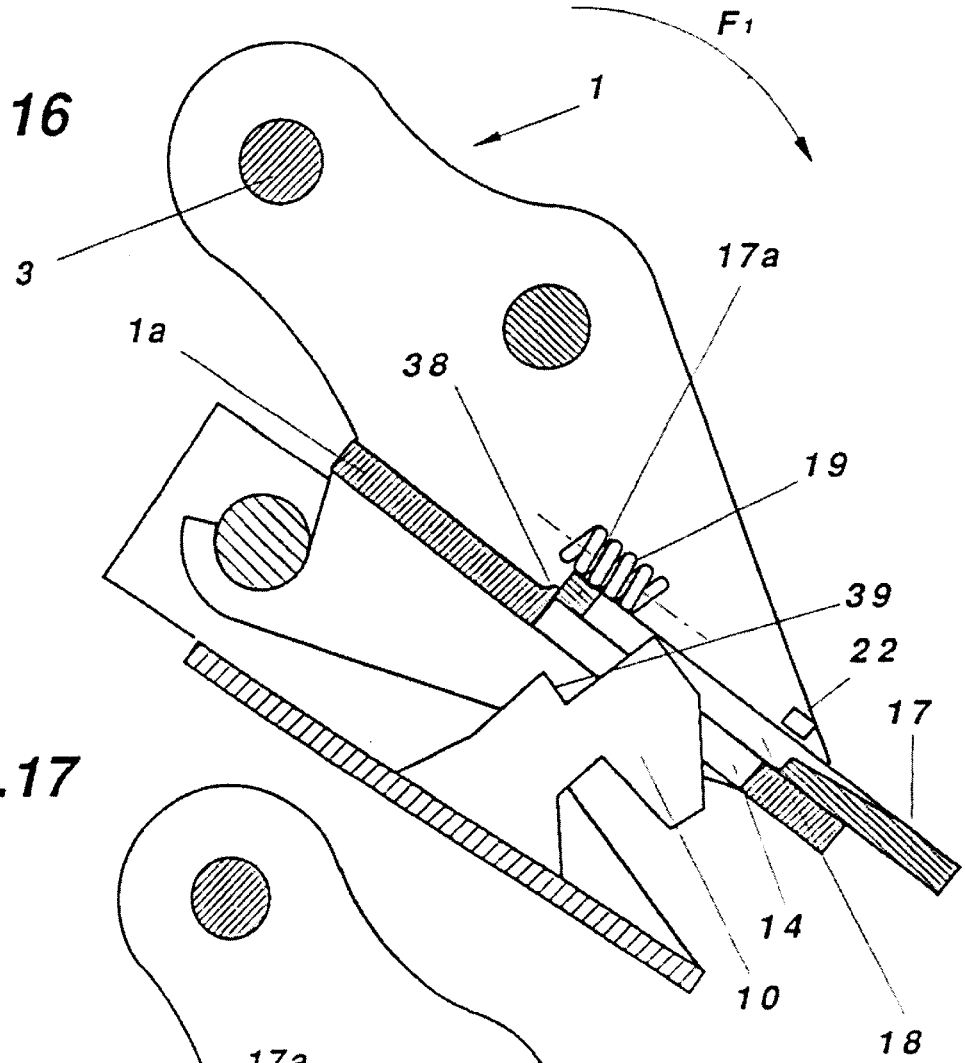
FIG. 16 is a view, similar to that 6, showing another embodiment.
Figure 17:
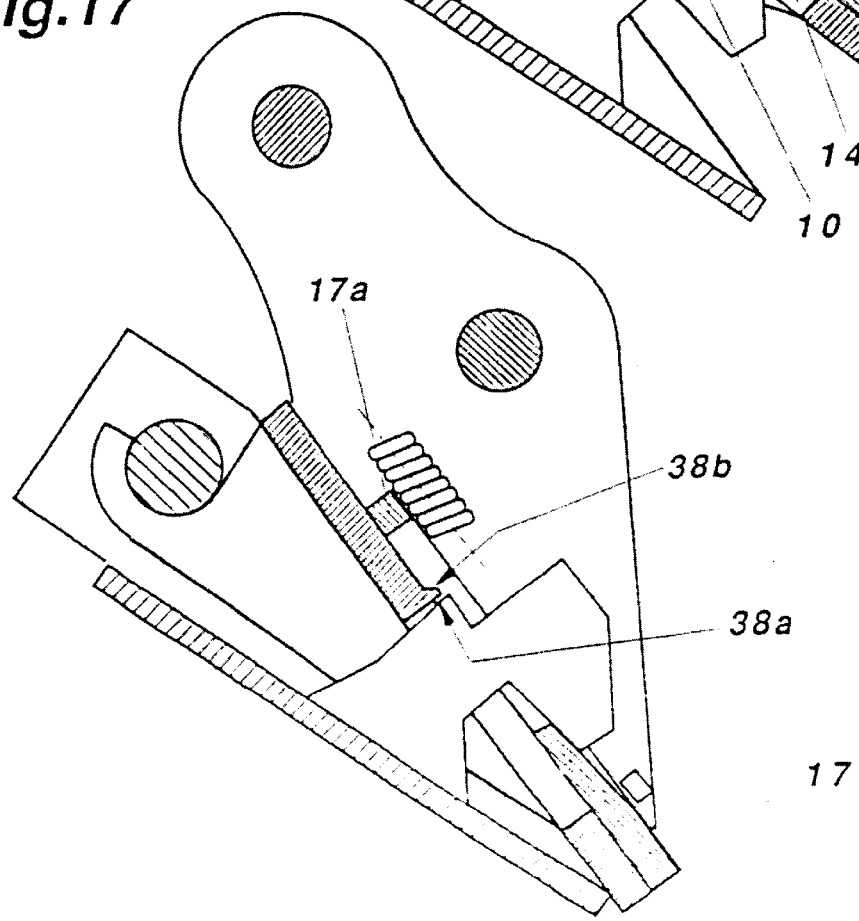
FIG. 17 is a view, similar to that 8, related to the embodiment of FIG. 16.

It must be noted that in this embodiment, the springs 19 also function to force the plate 17 against portion 1*a*, and that only the pair of guides 22 shown in FIGS. 16 and 17 are required. A substantial clearance exists between the guides 22 and the upper portion of the plate 17.

The upper portion of the element 10 opposite the extension 12 has a shoulder 39.

When, from the position shown in FIG. 16, the element 1 pivots along the arrow $F_1$, the end 17*a* of the locking plate meets the shoulder 39, which causes it to be lifted. In fact, the plate 17 pivots slightly clockwise by taking support against the edge of the portion 1*a*, and by cambering each spring 19 in the plane of its longitudinal axis. As a result, the end 17*a* passes above the abutment 38 and, under the action of springs 19, which slacken, the plate 17 occupies the position shown in FIG. 17.

To facilitate the passage of the plate 17 from the position shown in FIG. 17 to that shown in FIG. 16, the abutment 38 has a ramp 38*b* at the rear of its support surface 38*a*.

The assembly of the manual mechanism/tool 29 for unlocking the device, which is described with reference to FIGS. 10–14, can be used with respect to the embodiment of FIGS. 16 and 17, it being noted that in this case, the finger 31 is journalled on the handle 30.

What is claimed is:

1. A quick fastener system for fixing a tool at the end of a loading arm, the system comprising:

a first part coupled to the loading arm;

the first part comprising a cradle and a first aperture;

a second part arranged on the tool;

the second part comprising an element having a hook-shaped extension and a shaft which is adapted to be engaged by the cradle;

the hook-shaped extension having an engaging surface;

a locking plate adapted to engage the hook-shaped extension;

the locking plate having an engaging surface and an aperture which receives the hook-shaped extension;

the engaging surface of the locking plate engaging the engaging surface of the hook-shaped extension while the hook-shaped extension protrudes through the first aperture and the aperture of the locking plate; and a mechanism for biasing the locking plate towards a position in which the engaging surface of the locking plate engages the engaging surface of the hook-shaped extension, wherein the tool is movable by the loading arm when the cradle engages the shaft and when the locking plate engages the hook-shaped extension, and wherein the locking plate moves towards the cradle when the locking plate engages the hook-shaped extension.

2. The system of claim 1, wherein the second part is immobilized with respect to the first part when the cradle engages the shaft and when the locking plate engages the hook-shaped extension.

3. The system of claim 1, wherein the first part comprises a catching member which has substantially the shape of a bracket.

4. The system of claim 1, wherein the first aperture is disposed in a median portion of the first part and wherein the locking plate is disposed between the median portion and the hook-shaped extension.

5. The system of claim 1, wherein the second part is one of fixed to the tool and integral with the tool.

6. The system of claim 1, further comprising a guide mechanism for guiding the locking plate, wherein the locking plate is constantly subjected to a force that tends to move the locking plate towards the shaft.

7. The system of claim 1, wherein the aperture of the locking plate is adapted to be substantially aligned with the first aperture when the tool is mounted to the loading arm.

8. A quick fastener system for fixing a tool at the end of a loading arm, the system comprising:

a first part coupled to the loading arm;

the first part comprising a cradle and a first aperture;

a second part arranged on the tool;

the second part comprising an element having a hook-shaped extension and a shaft which is adapted to be engaged by the cradle; and a locking member adapted to engage the hook-shaped extension, wherein the tool is movable by the loading arm when the cradle engages the shaft and when the locking member engages the hook-shaped extension, and wherein the locking member moves towards the cradle when the locking member engages the hook-shaped extension, and further comprising a finger adapted to engage the locking member, wherein the finger is one of movably mounted and pivotally mounted to the first part.

9. The system of claim 8, wherein the finger comprises a shoulder which is adapted to engage the locking plate in order to maintain the locking plate in an armed position.

10. The system of claim 9, wherein the finger comprises an extended portion which is adapted to be engaged by an abutment disposed on the tool.

11. The system of claim 10, wherein the abutment is disposed on the element and wherein the abutment engages the finger when the tool is pivoted towards a locked position.

12. The system of claim 1, wherein the first part comprises an abutment which is adapted to engage the locking plate.

13. The system of claim 12, wherein the abutment is disposed on an upper surface of a median portion of the first part, and wherein the abutment maintains the locking plate in an armed position against a force which acts to bias the locking plate towards the hook-shaped extension.

14. The system of claim 1, wherein the locking plate is biased towards the upper surface of the median portion.

15. The system of claim 14, wherein the element comprises a shoulder which is adapted to engage the locking plate.

16. The system of claim 15, wherein the element further comprises a ramp which is adapted to engage an edge of the locking plate so as to move the locking plate away from the hook-shaped extension.

17. The system of claim 1, wherein the locking plate is adapted to be moved away from the hook-shaped extension via an unlocking tool.

18. A quick fastener system for fixing a tool at the end of a loading arm, the system comprising:

a first part coupled to the loading arm;

the first part comprising a cradle and a first aperture;

a second part arranged on the tool;

the second part comprising an element having a hook-shaped extension and a shaft which is adapted to be engaged by the cradle; and a locking member adapted to engage the hook-shaped extension, wherein the tool is movable by the loading arm when the cradle engages the shaft and when the locking member engages the hook-shaped extension, wherein the locking member is adapted to be moved away from the hook-shaped extension via an unlocking tool, and wherein the locking member comprises two ears which each include a slit which is adapted to be engaged by at least one finger of the unlocking tool.

19. The system of claim 18, wherein the at least one finger of the unlocking tool comprises an engaging pin which is adapted to engage the slit.

20. The system of claim 1, wherein each of the first part and the second part comprises engaging surfaces which are adapted to immobilize the tool with respect to the first part.

21. The system of claim 20, wherein the engaging surfaces are beveled.

22. The system of claim 1, wherein the element and the locking plate each comprise a corresponding tapered engaging surface.

23. A quick fastener system for fixing a tool at the end of a loading arm, the system comprising:

a catching member pivotally connected to the loading arm and comprising a hook-shaped cradle;

an element having a hook-shaped extension mounted to the tool;

a shaft which is adapted to be engaged by the cradle mounted to the tool; and a locking plate adapted to engage the hook-shaped extension;

the hook-shaped extension having an engaging surface;

the locking plate having an engaging surface and an aperture which receives the hook-shaped extension;

the engaging surface of the locking plate engaging the engaging surface of the hook-shaped extension while the hook-shaped extension protrudes through the aperture of the locking plate; and a mechanism for biasing the locking plate towards a position in which the engaging surface of the locking plate engages the engaging surface of the hook-shaped extension, wherein the loading arm is adapted to pivotally move the tool when the cradle engages the shaft and when the locking plate engages the hook-shaped extension, and wherein the locking plate moves towards the cradle when the locking plate engages the hook-shaped extension.

24. A quick fastener system for fixing a tool at the end of a loading arm, the system comprising:

a first part movably mounted to the loading arm;

the first part comprising a cradle, a biased movable locking plate, and a mechanism for obstructing the movement of the locking plate;

a second part coupled on the tool; and the second part comprising an element having a hook-shaped extension and a shaft which is adapted to be engaged by the cradle;

the hook-shaped extension having an engaging surface;

the locking plate having an engaging surface and an aperture which receives the hook-shaped extension;

the engaging surface of the locking plate engaging the engaging surface of the hook-shaped extension while the hook-shaped extension protrudes through the aperture of the locking plate; and the locking plate being biased towards a position in which the engaging surface of the locking plate engages the engaging surface of the hook-shaped extension, wherein the tool is non-movably connected to the first part when the cradle engages the shaft and when the locking plate engages the hook-shaped extension, and wherein the locking plate moves towards the cradle when the locking plate engages the hook-shaped extension.

* * * * *